US009671757B1

(12) United States Patent
Yuen

(10) Patent No.: US 9,671,757 B1
(45) **Date of Patent: *Jun. 6, 2017**

(54) SMARTWATCH ASSEMBLIES HAVING ANALOG DIALS AND RELATED METHODS

(71) Applicant: Michael M. Yuen, Hong Kong (CN)

(72) Inventor: Michael M. Yuen, Hong Kong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/078,757

(22) Filed: Mar. 23, 2016

Related U.S. Application Data

(63) Continuation of application No. 14/983,262, filed on Dec. 29, 2015.

(51) Int. Cl.
*G04B 19/30* (2006.01)
*G04G 17/04* (2006.01)
*G04G 9/00* (2006.01)

(52) U.S. Cl.
CPC ..... *G04B 19/30* (2013.01); *G04G 9/007* (2013.01); *G04G 17/045* (2013.01)

(58) Field of Classification Search
CPC ..... G04B 19/30; G04B 9/007; G04B 17/045; G04C 17/02; G04G 9/04
USPC ..... 368/241, 227, 71, 83, 88
See application file for complete search history.

(56) References Cited

U.S. PATENT DOCUMENTS 7,646,678 B2 * 1/2010 Imai ..... G04C 17/02 368/241
9,377,762 B2 * 6/2016 Hoobler ..... G04G 9/00
9,395,695 B2 * 7/2016 Kim ..... G04B 19/30
2005/0243653 A1 11/2005 Lizzi
2015/0333203 A1 11/2015 Cardi et al.
2015/0364066 A1 12/2015 Djafer et al.
2016/0072430 A1 3/2016 Gilbert et al.
2016/0126407 A1 5/2016 Cardi et al.
(Continued)

FOREIGN PATENT DOCUMENTS

EP 2951510 A1 12/2015
EP 2984682 A1 2/2016
(Continued)

OTHER PUBLICATIONS

Wu et al., A Precise Drunk Driving Detection Using Weighted Kernel Based On Electrocardiogram, Sensors 2016, 16, 659. 9 pages.

*Primary Examiner* — Edwin A. Leon
(74) *Attorney, Agent, or Firm* — TraskBritt

(57) ABSTRACT

A smartwatch assembly may include a dial portion having a plurality of apertures extending therethrough and a circuit board having a plurality of LED modules disposed thereon. The plurality of LED modules may be oriented to emit light toward the plurality of apertures of the dial portion. The circuit board may include a control module configured to illuminate the plurality of LED modules in response to an alert and a communication module configured to interface with an electronic device wirelessly and to receive the alert. Methods of making a smartwatch assembly may include disposing a dial portion having a face plate and a plurality of hour-mark apertures extending through the face plate in a watch casing and disposing a circuit board having a plurality of LED modules disposed thereon in a watch casing, the plurality of LED modules corresponding to the plurality of hour-mark apertures.

21 Claims, 9 Drawing Sheets

(56) References Cited

U.S. PATENT DOCUMENTS

| | | | |
|---|---|---|---|
| 2016/0211397 | A1 | 7/2016 | Kerzabi |
| 2016/0269719 | A1 | 9/2016 | Gagliano |

FOREIGN PATENT DOCUMENTS

| | | | |
|---|---|---|---|
| EP | 3000131 | A1 | 3/2016 |
| EP | 3028312 | A1 | 6/2016 |
| EP | 3063586 | A1 | 9/2016 |
| WO | 2016016519 | A1 | 2/2016 |
| WO | 2016059303 | A1 | 4/2016 |
| WO | 2016087724 | A1 | 6/2016 |
| WO | 2016087725 | A1 | 6/2016 |

* cited by examiner

SMARTWATCH ASSEMBLIES HAVING ANALOG DIALS AND RELATED METHODS

CROSS-REFERENCE TO RELATED APPLICATION

This application is a continuation of U.S. patent application Ser. No. 14/983,262, filed Dec. 29, 2015, pending, the disclosure of which is hereby incorporated herein in its entirety by this reference.

TECHNICAL FIELD

This disclosure relates generally to smartwatch assemblies and methods of making smartwatch assemblies. Specifically, this disclosure relates to smartwatch assemblies that have analog dials and that can alert users of events through LED modules and vibrations.

BACKGROUND

Smartwatches are wristwatches that have functionality beyond timekeeping. Some smartwatches are portable media players, and some smartwatches run mobile apps using a mobile operating system. Smartwatches often include electronic display screens where a user can interface with the smartwatches and control their functionality. However, by having an electronic display screen, the smartwatches lose a classic analog look and are often bulky in order to accommodate the circuitry needed to have an electronic display screen.

Although smaller than smartphones, smartwatches can often be intrusive and/or distracting because the electronic display screen fully lights up when a text or email is received. Furthermore, by having an electronic display screen, the smartwatches drain battery power quickly and require recharging on a regular basis.

BRIEF SUMMARY

Some embodiments of the present disclosure include a smartwatch assembly. The smartwatch assembly may include a watch casing having a dial portion and a circuit board disposed therein. The dial portion may include a plurality of hour-mark apertures extending therethrough. The circuit board may include a plurality of LED modules disposed thereon. The plurality of LED modules may be oriented to emit light toward the plurality of hour-mark apertures of the dial portion.

Some embodiments of the present disclosure include a smartwatch assembly. The smartwatch assembly may include a watch casing having a dial portion and a circuit board disposed therein. The dial portion may include a face plate, a plurality of hour-mark apertures extending through the face plate, and an hour hand extending from a center of the face plate and pointing, at least generally, toward one or more of the hour-mark apertures. The circuit board may include a board portion, a plurality of LED modules disposed on the board portion and oriented to emit light through the plurality of hour-mark apertures of the dial portion, a control module configured to illuminate at least one LED module of the plurality of LED modules in response to one or more alerts, and a communication module configured to interface with an electronic device wirelessly and to receive the one or more alerts.

Some embodiments of the present disclosure include a method of making a smartwatch assembly. The method may include disposing a dial portion having a face plate and a plurality of hour-mark apertures extending through the face plate in a watch casing and disposing a circuit board having a plurality of LED modules disposed thereon in a watch casing, the plurality of LED modules corresponding to the plurality of hour-mark apertures.

Some embodiments of the present disclosure include a smartwatch assembly. The smart watch assembly may include a watch body, a dial portion, a plurality of light sources, and a control module. The dial portion may be disposed within the watch body and may include a face plate having a plurality of hour-mark positions, an hour hand extending radially from a center of the face plate, and a minute hand extending radially from a center of the face plate. The plurality of light sources may be disposed within the watch body and may be positioned to correlate to the plurality of hour-mark positions of the face plate of the dial portion. The control module may be configured to illuminate one or more of the plurality of light sources. Furthermore, the control module may be configured to cause one or more of the plurality of light sources to emit a first color of light to indicate to a user a first notification from a smartphone in wireless communication with the smartwatch assembly and to cause one or more of the plurality of light sources to emit a second color of light to indicate to the user a second notification from the smartphone.

BRIEF DESCRIPTION OF THE DRAWINGS

For a detailed understanding of the present disclosure, reference should be made to the following detailed description, taken in conjunction with the accompanying drawings, in which like elements have generally been designated with like numerals, and wherein.

DETAILED DESCRIPTION

The illustrations presented herein are not actual views of any particular smartwatch assembly, or any component thereof, but are merely idealized representations, which are employed to describe the present invention.

As used herein, any relational term, such as "first," "second," "adjacent," "front," "rear," etc., is used for clarity and convenience in understanding the disclosure and accompanying drawings, and does not connote or depend on any specific preference or order, except where the context clearly indicates otherwise. For example, these terms may refer to an orientation of elements of the smartwatch assembly when the smartwatch assembly is being worn by a user on the user's arm in a conventional manner for wearing watches.

Some embodiments of the present disclosure include a smartwatch assembly that includes a classic analog dial portion while having smart features. For example, the smartwatch assembly may be able to indicate to a user that the user's smartphone has received a text, email, voicemail, and/or phone call. Furthermore, the smartwatch assembly may be able to indicate to a user that the user's smartphone is sounding an alarm or attempting to remind the user of an appointment or task. The smartwatch assembly may indicate these alerts to a user by illuminating hour-mark positions of the dial portion of the smartwatch assembly with a plurality of LED modules. Furthermore, the smartwatch assembly may illuminate different patterns of the hour-mark positions to indicate different alerts to the user. For example, the smartwatch assembly may illuminate a first pattern of hour-mark positions to indicate that the user has received a text on his or her smartphone, and the smartwatch assembly may illuminate a second pattern of hour-mark positions to indicate that the user has received email on his or her smartphone.

Some embodiments of the present disclosure include a smartwatch assembly that tracks a user's activity. For example, the smartwatch assembly may track a user's walking, running, swimming, and/or sleeping. In some embodiments, the smartwatch assembly may interface with a software application (i.e., an "app") executed on an associated (e.g., a "paired") smartphone to track the user's activity. In other embodiments, the smartwatch assembly may include a plurality of sensors to track the user's activity.

Figure 1:
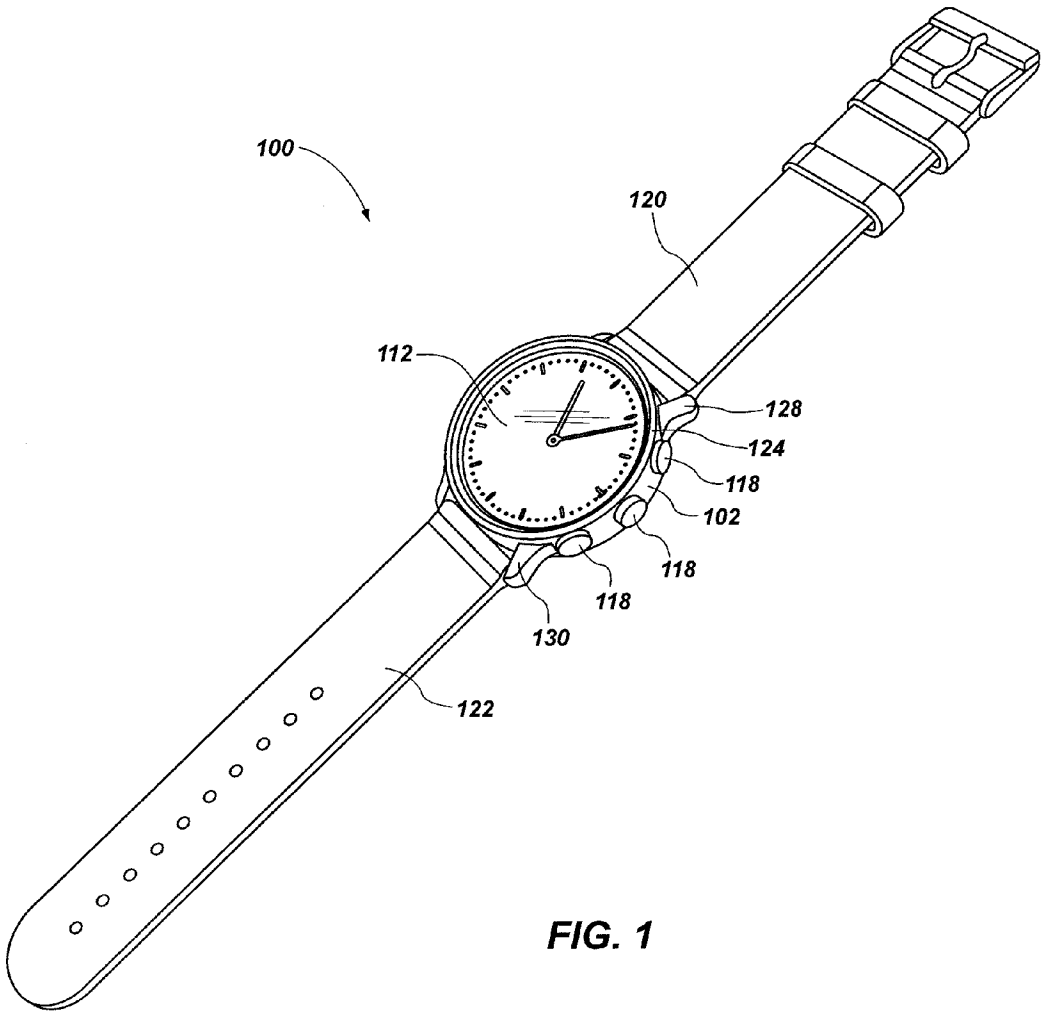
FIG. 1 is a perspective view of a smartwatch assembly according to an embodiment of the present disclosure.
Figure 2:
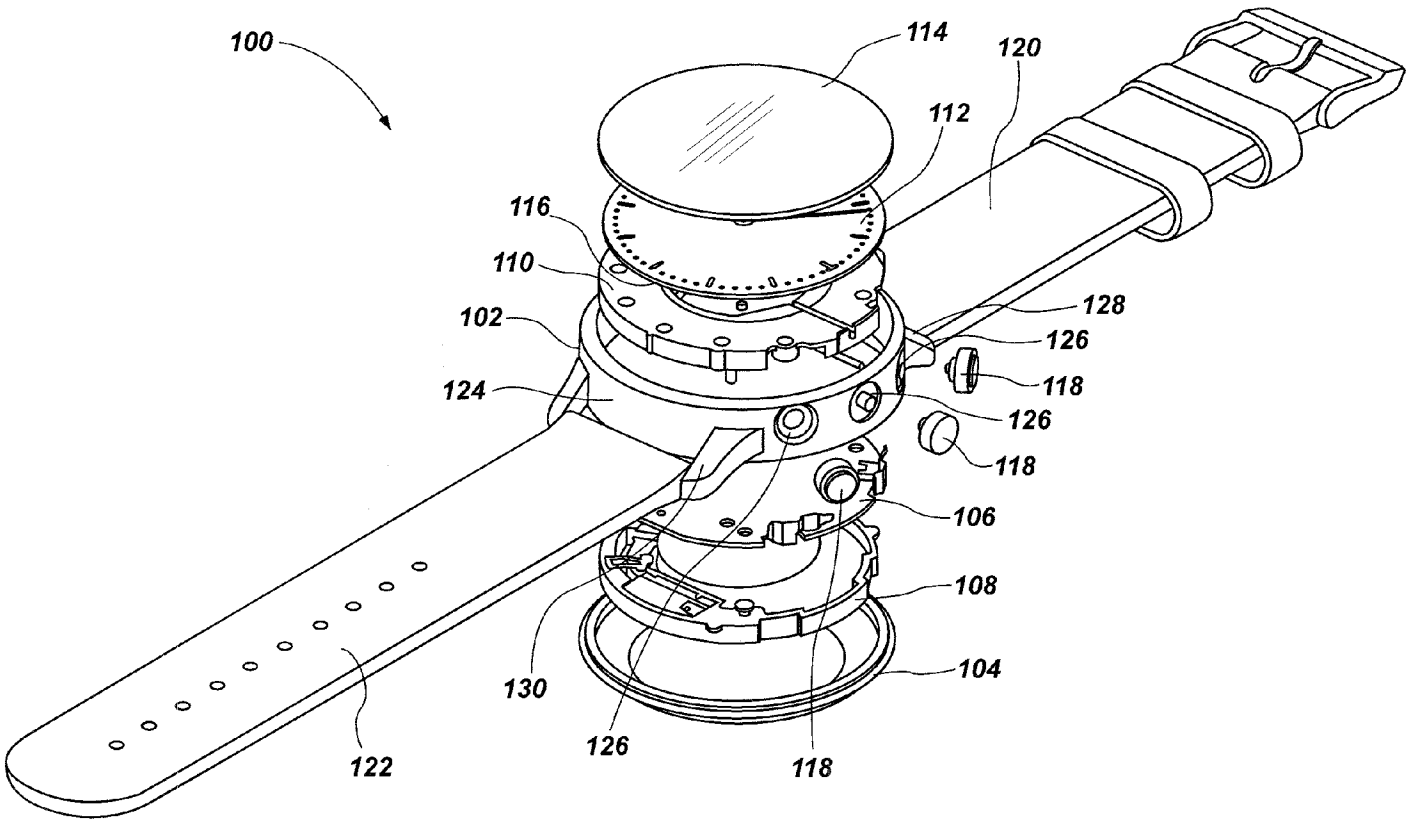
FIG. 2 is an exploded perspective view of the smartwatch assembly of FIG. 1.

FIG. 1 shows a perspective view of a smartwatch assembly 100 according to an embodiment of the present disclosure. FIG. 2 shows an exploded perspective view of the smartwatch assembly 100 of FIG. 1. Referring to FIGS. 1 and 2 together, the smartwatch assembly 100 may include a watch casing 102, a back cover 104, a printed circuit board assembly 106 ("PCBA 106"), a frame assembly 108, a light guide 110, a dial portion 112, a transparent portion 114, a light diffuser 116, a plurality of control mechanisms 11R, first strap 120, and a second strap 122.

The watch casing 102 may have a generally annular shape, and the PCBA 106, frame assembly 108, light guide 110, and dial portion 112 may be disposed within the watch casing 102. The back cover 104 may be removably coupled to a back side of the watch casing 102, and the transparent portion 114 may be attached to a front side of the watch casing 102, opposite the back side of the watch casing 102. As used herein, the phrase "back side" may refer to a side of the watch casing 102 that is intended to rest against the arm of a user when the smartwatch assembly 100 is worn by the user, and the phrase "front side" may refer to a side of the watch casing 102 that is intended to face away from the arm of the user when the smartwatch assembly 100 is worn by the user.

The frame assembly 108, PCBA 106, light guide 110, and dial portion 112 may be arranged within the watch casing 102 in a stacked formation (e.g., one on top of another). For example, the frame assembly 108 may be disposed adjacent to (e.g., next to) to the back cover 104. In other words, at least a portion of frame assembly 108 may be exposed when the back cover 104 is removed from the watch casing 102. The PCBA 106 may be disposed adjacent to (e.g., next to, on, over, etc.) the frame assembly 108 on a side of the frame assembly 108 opposite the back cover 104. In some embodiments, the PCBA 106 may be attached to the frame assembly 108 with at least one fastener (e.g., one or more screws). The light guide 110 may be disposed adjacent to (e.g., next to, on, over, etc.) the PCBA 106 and on a side of the PCBA 106 opposite the frame assembly 108. The dial portion 112 may be disposed adjacent to (e.g., next to, on, over, etc.) the light guide 110 and on a side of the light guide 110 opposite the PCBA 106.

As discussed above, the transparent portion 114 may be attached to the front side of the watch casing 102. The transparent portion 114 (e.g., a glass cover) may allow a user to view the dial portion 112 of the smartwatch assembly 100 through the transparent portion 114. For example, the transparent portion 114 may include one or more of glass, sapphire glass, a polymer, crystal, and aluminosilicate glass.

In some embodiments, the watch casing 102 may include an annular side wall 124 and a plurality of holes 126 extending through the annular side wall 124 from an outer circumference of the watch casing 102 to an inner circumference of the watch casing 102. The plurality of control mechanisms 118 may be disposed in and extend through the plurality of holes 126 and may be operably coupled to the PCBA 106. In some embodiments, the plurality of control mechanisms 118 may include one or more of a button, a switch, and a crown.

In some embodiments, the watch casing 102 may include a first lug 128 and a second lug 130. The first and second lugs 128, 130 may extend out radially from the annular side wall 124 of the watch casing 102 on opposite sides of the watch casing 102. The first strap 120 may be coupled to the first lug 128, and the second strap 122 may be coupled to the second lug 130. The first and second straps 120, 122 may be sized and shaped to be wrapped around an arm of a user and to fasten the smartwatch assembly 100 to the arm of the user.

Figure 3:
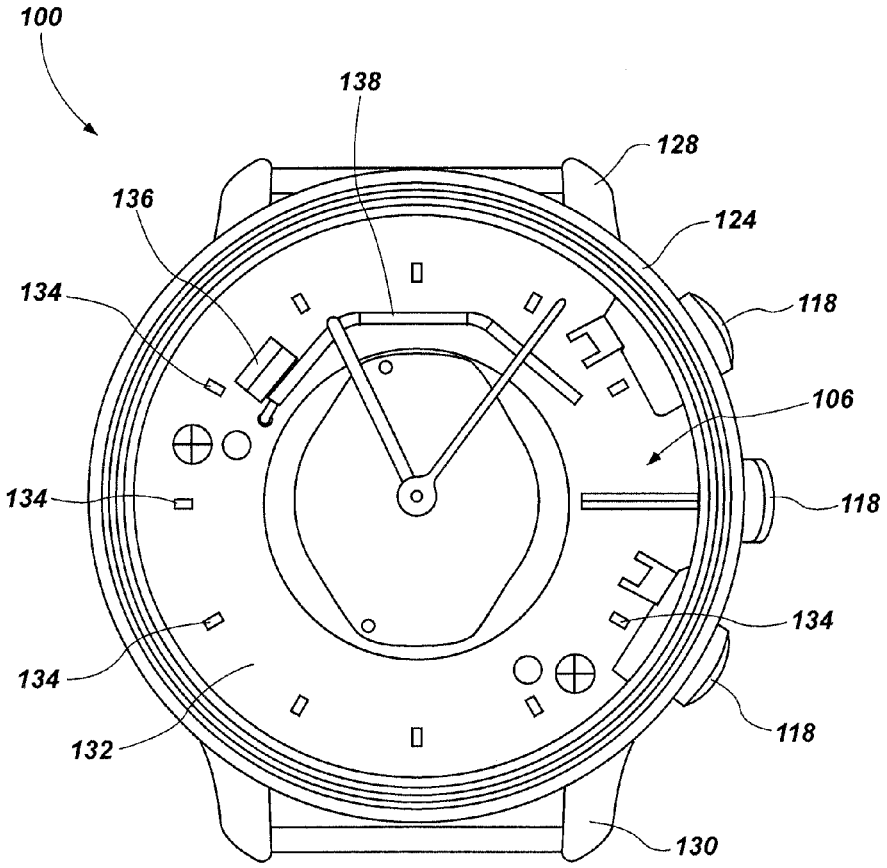
FIG. 3 is a front plan view of a smartwatch assembly showing a printed circuit board assembly of the smartwatch assembly according to an embodiment of the present disclosure.

FIG. 3 is a front side view of a smartwatch assembly 100 with the first and second straps 120, 122 and the dial portion 112 removed to show an internal structure of the smartwatch assembly 100 according to an embodiment of the present disclosure. The PCBA 106 of the smartwatch assembly 100 may include a printed circuit board portion 132, a plurality of light sources 134 (e.g., a plurality of LED modules 134), a control module 136, and a communication module 138. The plurality of LED modules 134 may be operably coupled to the control module 136, and the control module 136 may control when the plurality of LED modules 134 is illuminated. In some embodiments, the control module 136 may include a microcontroller (i.e., an MCU).

The plurality of LED modules 134 may include an LED module 134 disposed and located to correlate to (e.g., in alignment with) each hour-mark position of the dial portion 112 (e.g., each hour-mark position of a conventional watch or clock). For example, the plurality of LED modules 134 may include an LED module 134 at each of a 12 o'clock position, a 1 o'clock position, a 2 o'clock position, etc., of a conventional analog watch. In some embodiments, a 3 o'clock position may not include an LED module 134 due to positioning of the plurality of control mechanisms 118. In other embodiments, the plurality of LED modules 134 may include an LED module 134 at each hour-mark position.

Each LED module 134 of the plurality of LED modules 134 may include a white LED or white LED module and at least one colored LED or colored LED module. The at least one colored LED may include one or more of a blue LED, green LED, red LED, yellow LED, purple LED, orange LED. Although specific colors are listed, the at least one colored LED may include an LED of any color. For example, the at least one colored LED may include an LED of any color within the color spectrum. In some embodiments, a color of the at least one LED module may be altered by changing a voltage being applied to the at least one LED.

In some embodiments, the plurality of light sources 134 may include one or more of liquid crystal displays, incandescent lights, or compact fluorescents.

The communication module 138 may be operably coupled to the control module 136 and may enable the smartwatch assembly 100 to communicate with other devices wirelessly. For example, the communication module 138 may enable the smartwatch assembly 100 to communicate with other devices through Wi-Fi, BLUETOOTH® 2.0, BLUETOOTH® low energy ("BLE") 4.0, infrared communication, ANT, ANT+, etc. In some embodiments, the communication module 138 may enable the smartwatch assembly 100 to communicate with a smartphone, such as, for example, an iPHONE® or an ANDROID® phone. For example, the control module 136 may be able to communicate with devices using iOS software and/or Android software. In some embodiments, an app specific to the smartwatch assembly 100 may be installed on a smartphone (hereinafter "SW app") and may allow a user to customize features of the smartwatch assembly 100 from the smartphone. In some embodiments, the SW app and/or smartwatch assembly 100 may interface with, for example, the HEALTH KIT® App and/or the GOOGLE FIT® App or any other app designed to track a user's activity. As used herein, the term "activity" may refer to physical activity such as walking, running, swimming, burning calories, etc. Furthermore, the term "activity" may include other activities such as sleeping. In some embodiments, the smartwatch assembly 100 may communicate with and interface with other apps on a smartphone, such as, for example, mail apps, texting apps, call placing and receiving apps, sleep tracking apps, map apps, alarm apps, and global positioning apps. Moreover, the smartwatch assembly 100 may access data on the smartphone such as, for example, global positioning data, activity data, usage data, etc. In some embodiments, the smartwatch assembly 100 may be in at least substantially constant wireless communication with the smartphone. In some embodiments, the smartwatch assembly 100 may be able to stay in constant communication with the smartphone when the smartwatch assembly 100 is within approximately 50 meters of the smartphone. In some embodiments, the smartwatch assembly 100 may be able to stay in constant communication with the smartphone when the smartwatch assembly 100 is within approximately 100 meters of the smartphone. In some embodiments, the smartwatch assembly 100 may be able to stay in constant communication with the smartphone when the smartwatch assembly 100 is within approximately 150 meters of the smartphone.

Although the smartwatch assembly 100 is described herein as communicating with a smartphone, embodiments of the present disclosure may not be so limited. For example, the smartwatch assembly 100 may communicate and may interface with one or more of a computer, a laptop, a personal digital assistant, a pedometer, and other mobile devices such as a FITBIT®, JAWBONE®, and other smartwatches. To facilitate explanation of the smartwatch assembly 100, the smartwatch assembly 100 will be described herein as communicating and interfacing with a smartphone. However, it is understood that that smartwatch assembly 100 may communicate and interface with any of the above-listed devices.

In some embodiments, the control module 136 may cause one or more of the plurality of LED modules 134 to illuminate in response to one or more events on the smartphone (referred to herein as "alerts"). For example, the control module 136 may cause one or more of the plurality of LED modules 134 to illuminate when a text, phone call, email, and/or voicemail is received on the smartphone. Furthermore, in some embodiments, control module 136 may cause one or more of the plurality of LED modules 134 to illuminate in response to activity performed by the user and as measured (e.g., tracked) by the smartphone or smartwatch assembly 100. In other words, the smartwatch assembly 100 may track an activity performed by the user and may indicate tracked (e.g., measured, recorded, sensed, etc.) activity to the user by illuminating one or more of the plurality of LED modules 134. For example, the control module 136 may cause one or more of the plurality of LED modules 134 to illuminate to indicate to a user a quantity and/or quality of an activity (e.g., walking, running, swimming, calories burned, sleeping, etc.) performed by the user.

Figure 4:
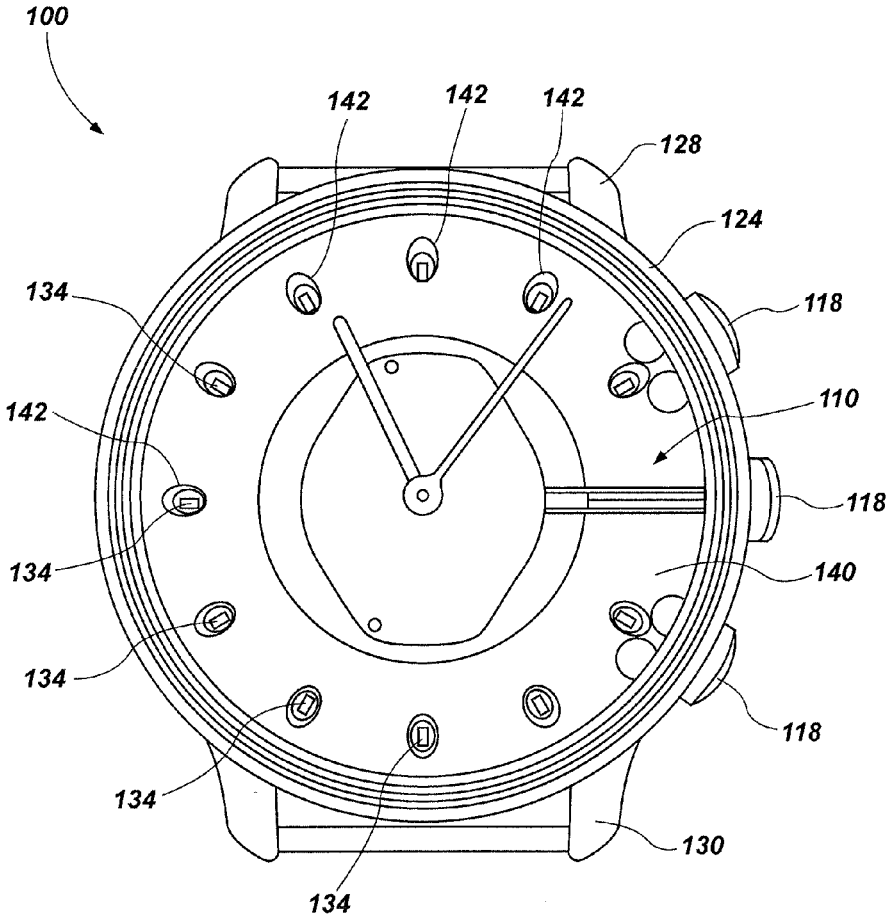
FIG. 4 is a front plan view of a smartwatch assembly showing a light guide assembly of the smartwatch assembly according to an embodiment of the present disclosure.

FIG. 4 is a front side view of a smartwatch assembly 100 showing the light guide 110 according to an embodiment of the present disclosure. Some portions of the smartwatch assembly 100 are removed to show the internal structure of the smartwatch assembly 100. Referring to FIGS. 3 and 4 together, as discussed above, the light guide 110 may be disposed adjacent to and proximate to the PCBA 106. The light guide 110 may include a plate portion 140 having a plurality of light guide holes 142 extending therethrough. In some embodiments, the plate portion 140 of the light guide 110 may have a generally annular shape and may extend over portions of the PCBA 106 having the plurality of LED modules 134. The plurality of light guide holes 142 may include a light guide hole 142 for each LED module 134 of the plurality of LED modules 134 of the PCBA 106. For example, the light guide 110 may be oriented relative to the PCBA 106 such that each LED module 134 of the plurality of LED modules 134 is positioned within (e.g., aligned with) a respective light guide hole 142 of the plurality of light guide holes 142, and light emitted by the plurality of LED modules 134 may pass through the plurality of light guide holes 142, respectively. Put another way, each light guide hole 142 of the plurality of light guide holes 142 may correspond to an hour-mark position of the dial portion 112 (FIG. 1) of the smartwatch assembly 100. The material of the light guide 110 may be at least substantially non-transparent (e.g., opaque) to the light emitted by the LED modules 134, such that the light emitted by the LED modules 134 is only able to pass through the light guide holes 142 and not through the material of the light guide 110. The plurality of light guide holes 142 may be sized and shaped to guide light emitted by the plurality of LED modules 134 toward the dial portion 112 (FIG. 1) of the smartwatch assembly 100. Furthermore, the plurality of light guide holes 142 may help to prevent light from being emitted in a wrong direction (e.g., away from the dial portion 112 (FIG. 1)). As a result, the light guide 110 may lead to more light being viewable by a user and may reduce an amount of power need to achieve a desired amount of light reaching the dial portion 112 of the smartwatch assembly 100.

Figure 5:
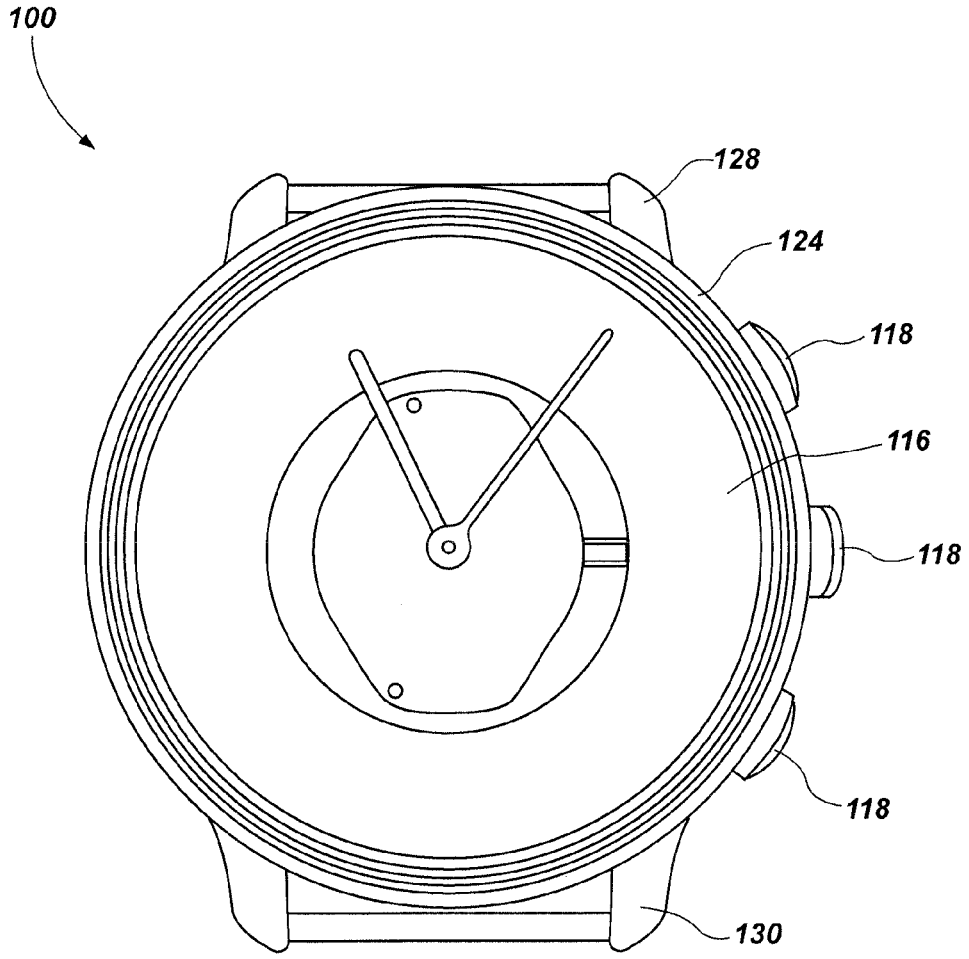
FIG. 5 is a front plan view of a smartwatch assembly showing a light diffuser of the smartwatch assembly according to an embodiment of the present disclosure.

FIG. 5 is a front side view of a smartwatch assembly 100 showing the light diffuser 116 according to an embodiment of the present disclosure. Some portions of the smartwatch assembly 100 are removed to show the internal structure of the smartwatch assembly 100. As discussed above, the light diffuser 116 may be disposed adjacent to the light guide 110 (FIG. 4) on a side of the light guide 110 (FIG. 4) opposite the PCBA 106 (FIG. 3). The light diffuser 116 may have a generally annular shape and, in some embodiments, may cover at least substantially all of light guide holes 142 (FIG. 4) of the light guide 110 (FIG. 4). In some embodiments, the light diffuser 116 may include a thin film of material. For example, the light diffuser 116 may include a MYLAR® film. In some embodiments, the light diffuser 116 may include one or more of a polyester film and a polyethylene terephthalate sheet.

Referring to FIGS. 1, 3, and 5 together, the light diffuser 116 may be translucent (e.g., semitransparent) so as to allow at least some light emitted by the plurality of LED modules 134 to pass therethrough. In some embodiments, the light diffuser 116 may diffuse (e.g., spread, scatter, distribute) light emitted by the plurality of LED modules 134 to provide an omni-directional emission of the light to a user on the dial portion 112 of the smartwatch assembly 100, emitting respectively from the locations of the light guide holes 142 in the light guide 110. For example, light emitted by the plurality of LED modules 134 may be at least substantially directional (e.g., may have a narrow viewing angle) and without the light diffuser 116, the light may not be readily viewable from at least some angles from which the smartwatch assembly 100 may typically be viewed. With the light diffuser 116, the light emitted by the plurality of LED modules 134 may be viewable from a wider range of angles. For example, the light diffuser 116 may enable light emitted by the plurality of LED modules 134 to be viewable within a viewing angle, as would be understood by one of ordinary skill in the art, of approximately 175°. In some embodiments, the smartwatch assembly 100 may not include a light diffuser 116 but may include LED modules 134 having wider viewing angles.

Figure 6:
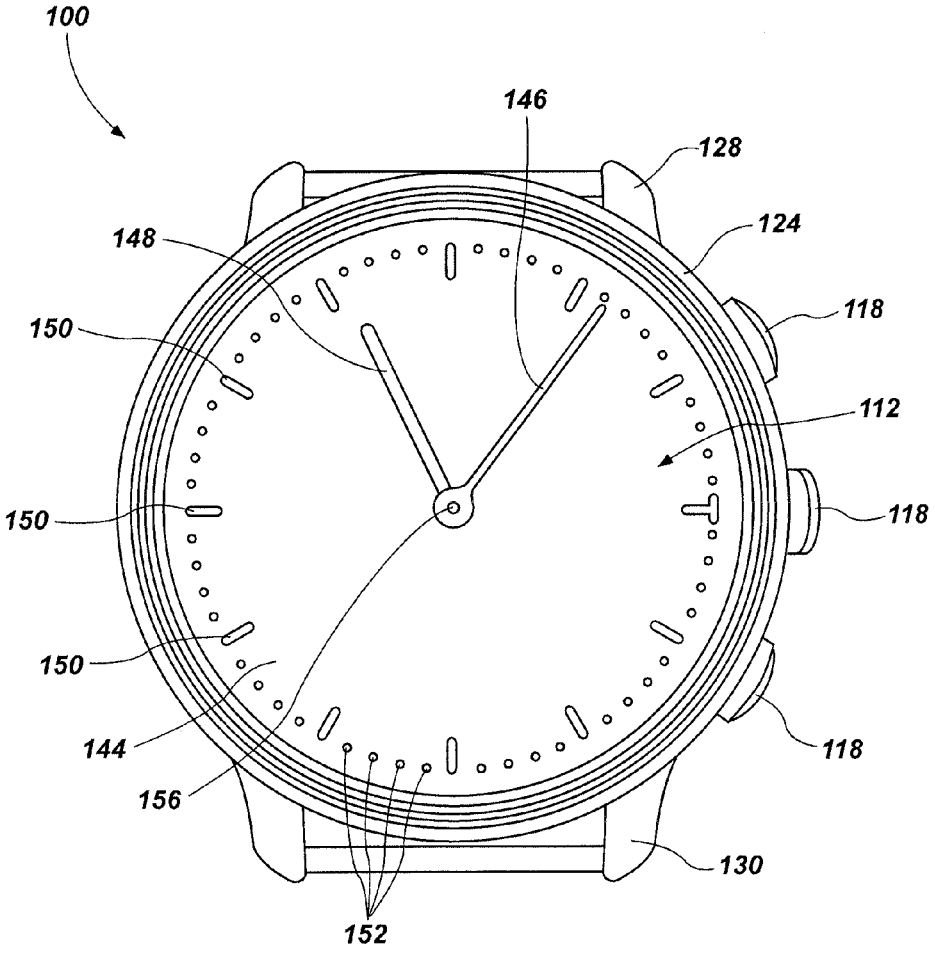
FIG. 6 is a front plan view of a smartwatch assembly showing a dial portion of the smartwatch assembly according to an embodiment of the present disclosure.

FIG. 6 is a front side view of a smartwatch assembly 100 showing a dial portion 112 of the smartwatch assembly 100 according to an embodiment of the present disclosure. Some portions of the smartwatch are removed to show the structure of the smartwatch assembly 100. The dial portion 112 of the smartwatch assembly 100 may include a face plate 144, a minute hand 146, an hour hand 148, a plurality of hour-mark apertures 150, and a plurality of minute-mark apertures 152. The plurality of hour-mark apertures 150 and the plurality of minute-mark apertures 152 may extend through the face plate 144. The plurality of hour-mark apertures 150 may be located proximate an outer peripheral edge 154 of the face plate 144, and each hour-mark aperture 150 of the plurality of hour-mark apertures 150 may correspond to an hour-mark position of the face plate 144 (e.g., hour-mark positions of a conventional clock face). The plurality of minute-mark apertures 152 may also be located proximate the outer peripheral edge 154 of the face plate 144, and each minute-mark aperture 152 of the plurality of minute-mark apertures 152 may correspond to a minute-mark position of the face plate 144 (e.g., minute positions of a conventional clock face). In some embodiments, the plurality of hour-mark apertures 150 may be larger in size than the plurality of minute-mark apertures 152.

The plurality of hour-mark apertures 150 and the plurality of minute-mark apertures 152 may enable light emitted by the plurality of LED modules 134 (FIG. 3) through the light guide 110 (FIG. 4) and light diffuser 116 (FIG. 5) to pass therethrough. As a result, the light emitted by the plurality of LED modules 134 may be viewable to a user through the dial portion 112 of the smartwatch assembly 100. Furthermore, the light emitted by the plurality of LED modules 134 may illuminate (e.g., lighten, brighten, irradiate) the plurality of hour-mark apertures 150 and the plurality of minute-mark apertures 152.

The minute hand 146 and hour hand 148 of the dial portion 112 may extend from a center 156 of the face plate 144 toward the plurality of hour-mark apertures 150 and the plurality of minute-mark apertures 152. For example, the smartwatch assembly 100 may include a conventional minute and hour hand 146, 148 of an analog watch. The minute hand 146 and the hour hand 148 may rotate about an axis extending through the face plate 144 and orthogonal to a face surface of the face plate 144.

The dial portion 112 of the smartwatch assembly 100 may not include an electronic display screen. In other words, the dial portion 112 may not include a graphical interface.

As discussed above, the glass portion of the smartwatch assembly 100 may be disposed above (e.g., spaced apart from) the dial portion 112, and the dial portion 112 may be viewable through the glass portion.

Figure 7:
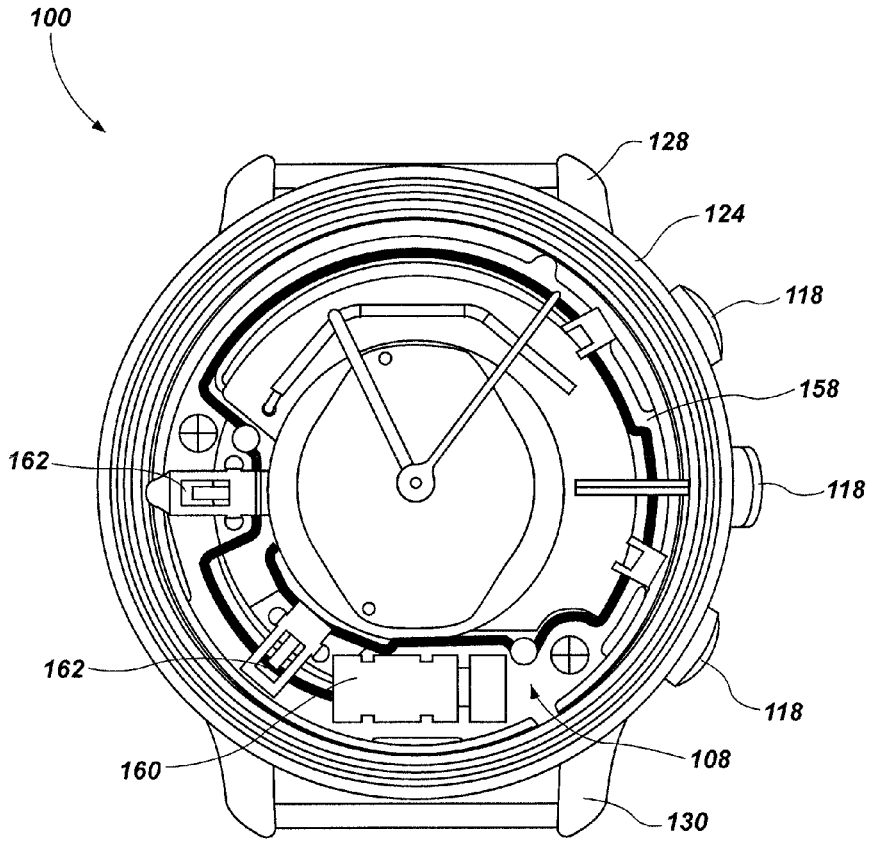
FIG. 7 is a front plan view of a smartwatch assembly showing a frame assembly of the smartwatch assembly according to an embodiment of the present disclosure.

FIG. 7 is a front side view of the smartwatch assembly 100 showing the frame assembly 108. Some portions of the smartwatch assembly 100 are removed to show the internal structure of the smartwatch assembly 100. The frame assembly 108 may include a frame structure 158, a vibrator 160, and a plurality of sensors 162.

The frame structure 158 may be sized and shaped to receive at least one battery. In some embodiments, the frame structure 158 may be sized and shaped to receive at least two batteries. In such embodiments, the frame structure 158 may be sized and shaped to receive a first battery to power smart features (e.g., powering the control module 136, communication module 138, and plurality of LED modules 134) of the smartwatch assembly 100 and a second battery to power timekeeping features.

The vibrator 160 may be mounted to the frame assembly 108 and may include a conventional motor that spins an off-center weight to cause vibrations. The vibrator 160 may be operably coupled to the control module 136 (FIG. 3) and may be used (e.g., caused to vibrate) in response to certain events, such as, an alarm of the smartphone and the smartphone receiving a text, email, voicemail, and/or phone call. The plurality of sensors 162 may be operably coupled to the control module 136 (FIG. 3) and may include one or more of a magnetic pendulum (i.e., pedometer) and a sleep monitor. For example, the plurality of sensors 162 may include at least one multi-axis accelerometer. In some embodiments, the accelerometer may include at least 3 axes. In some embodiments, the accelerometer may include at least 6 axes. The plurality of sensors 162 may provide information to the control module 136 (FIG. 3) to track activity of a user.

Figure 8:
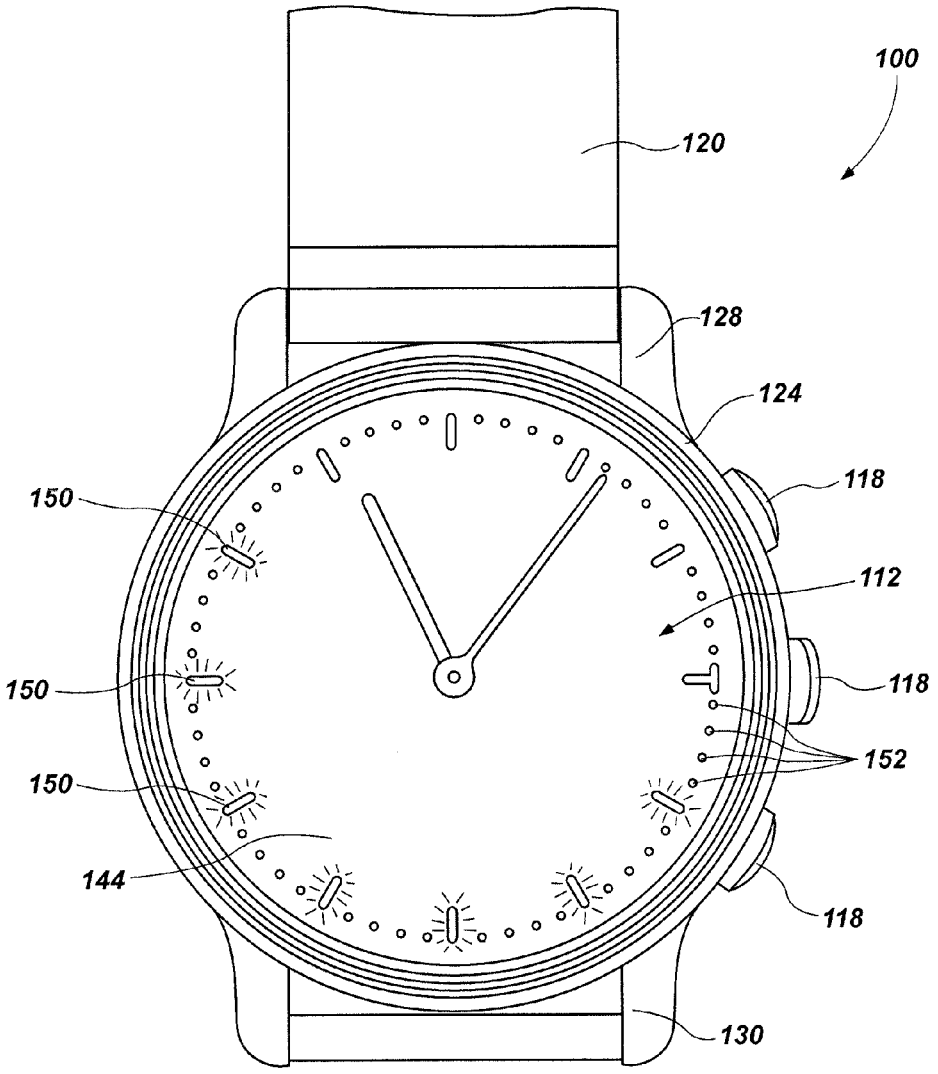
FIG. 8 is a front plan view of a smartwatch assembly showing a dial portion of the smartwatch assembly having a plurality of LED modules illuminated according to an embodiment of the present disclosure.

FIG. 8 is a partial front side of the smartwatch assembly 100 showing the dial portion 112 with a number of the plurality of LED modules 134 (FIG. 3) illuminated. Referring to FIGS. 3 and 8 together, as discussed above, in some embodiments, the smartwatch assembly 100 may track activity of user. For example, the smartwatch assembly 100 may track one or more of steps taken, running distance, calories burned, swimming strokes, and sleep time and quality of sleep.

As discussed above, the smartwatch assembly 100 may interface with a smartphone via wireless communication, and the functionality of the smartwatch assembly 100 may be customizable via the SW app on the smartphone. For example, via the SW app, a user may cause the smartwatch assembly 100 to track one or more of steps taken, running distance, calories burned, swimming strokes, and sleep time and quality of sleep. Furthermore, the user may set goals in one or more of the above categories.

The smartwatch assembly 100 may indicate to a user measurements and/or progression of a chosen activity during a period of time (e.g., a day) by illuminating a portion of the plurality of LED modules 134, which may, in turn, illuminate portions of the face plate 144 of the dial portion 112 of the smartwatch assembly 100. As a non-limiting example, a user may set a goal of steps to take for a day, and the smartwatch may track the user's progress on achieving the goal.

In some embodiments, each hour segment of the face plate 144 of the dial portion 112 may represent a percentage of the goal. For example, a goal may be divided by twelve and each hour segment may represent about 8.33% of a goal. For example, with a goal of 10,000 steps, each hour segment of the face plate 144 of the dial portion 112 may represent 833 steps. As a result, once a user has taken 833 steps during a given period of time (e.g., a day), an hour segment of the face plate 144 of the dial portion 112 may be illuminated, and after each subsequent set of 833 steps taken by the user, an additional hour segment will illuminate. In some embodiments, each subsequent hour segment that is illuminated may be an hour segment that is immediately adjacent a previously illuminated segment in a clockwise direction. In other words, as the hour segments are illuminated, the hour segments may be illuminated in a clockwise order.

In some embodiments, the first hour segment to illuminate to show progress of a goal may be the 4 o'clock hour since, in some embodiments, the 3 o'clock position of the smartwatch assembly 100 may not include an LED module 134. The second hour segment to illuminate to show progress of the goal may be the 5 o'clock hour, and any subsequent hour segments to illuminate may continue to be illuminated in a clockwise order. When all of the hour segments of the face plate 144 are illuminated, the user's goal has been completed. In other embodiments, the first hour segment to illuminate to show progress of a goal may be any hour-mark position.

In some embodiments, each hour segment may not represent a percentage of a goal. Rather, a user may set the smartwatch assembly 100 to have each hour segment represent a certain amount of steps. For example, a user may set the smartwatch assembly 100 to have each hour segment represent 500 steps, and after the user has taken 500 steps, an hour segment may be illuminated.

In some embodiments, the plurality of LED modules 134 may remain illuminated after being illuminated while tracking a user's activity. In other embodiments, the plurality of LED modules 134 will illuminate after the user achieves a milestone (e.g., a percentage of a goal and/or a set amount) for a brief period of time (e.g., 2 to 30 seconds) and then will extinguish. In such embodiments, a user may check his or her progress by engaging one or more of the control mechanisms 118. For example, the user may push one of the control mechanisms 118, which may cause the portion of the plurality of LED modules 134 indicating the percentage of the goal achieved and/or a total amount of activity achieved to illuminate. In some embodiments, the user may set illumination patterns of the smartwatch assembly 100 via the SW app on a smartphone.

In some embodiments, activity tracked by the smartwatch assembly 100 may be indicated with the white LED modules 134 of the plurality of LED modules 134. In other embodiments, activity tracked by the smartwatch assembly 100 may be indicated with colored LED modules 134. In some embodiments, activity tracked by the smartwatch assembly 100 may be indicated with both of the LE modules 134 and the colored LED modules 134 of the plurality of LED modules 134.

In the non-limiting example of tracking running distance, the user may customize the smartwatch assembly 100 via the SW app on a smartphone. The user may set the smartwatch to have each hour segment indicate a percentage of a goal or a set distance. For example, the user may set a goal of five miles and have each hour segment indicate a percentage of the five-mile goal. As another example, the user may set the smartwatch assembly 100 to have each hour segment indicate one mile.

In the non-limiting example of tracking calories burned, the user may set the smartwatch assembly 100 to have each hour segment indicate a percentage of a goal or a set number of calories. For example, the user may set a goal of 400 calories and have each hour segment indicate a percentage of the 400-calorie goal. As another example, the user may set the smartwatch assembly 100 to have each hour segment indicate 50 calories.

In the non-limiting example of tracking swimming strokes, the user may set the smartwatch assembly 100 to have each hour segment indicate a percentage of a goal or a set number of strokes. For example, the user may set a goal of burning 400 strokes and have each hour segment indicate a percentage of the 400-stroke goal. As another example, the user may set the smartwatch assembly 100 to have each hour segment indicate 50 strokes.

In the non-limiting example of tracking sleep time, the user may set the smartwatch assembly 100 to have each hour segment indicate a percentage of a set amount of time. For example, the user may set the smartwatch to track sleep during a set amount of time and to indicate hour much of that time the user spent sleeping. As a result, each hour segment may be set to indicate a percentage of the set amount of time or a set amount of time of sleep.

In the non-limiting example of tracking sleep quality, the user may set the smartwatch assembly 100 to have each hour segment indicate a counter for indicating a quality of sleep. In other words, the more hour segments that are illuminated, the higher quality of sleep the user has experienced. For example, when tracking sleep quality and when a user has had a high quality of sleep, the smartwatch assembly 100, after tracking the sleep, may illuminate seven to ten LED modules 134 (i.e., seven to ten hour segments). Additionally, when a user has had a medium quality of sleep, the smartwatch assembly 100 may illuminate four to six LED modules 134 (i.e., four to six hour segments). Moreover, when a user has had a low quality of sleep, the smartwatch assembly 100 may illuminate zero to three LED modules 134 (i.e., zero to three hour segments). The quality of sleep of a user may be tracked with the plurality of sensors 162 (FIG. 7) (e.g., the multi-axis accelerometer) by tracking movement of the user during a specified period of time. For example, less movement of the user may indicate a higher quality of sleep while more movement of the user may indicate a lower quality of sleep.

In some embodiments, different colors of the LED modules 134 may be used to indicate different qualities of sleep. As a non-limiting example, three blue-colored LED modules 134 may be illuminated to indicate to the user that the user had three hours of high quality of sleep, and three additional red-colored LED modules 134 may be illuminated to indicate to the user that the user had three hours of medium quality sleep.

In some embodiments, the smartwatch assembly 100 may use only a portion of the face plate 144 of the dial portion 112 to indicate activity tracked by the smartwatch assembly 100 to a user. For example, the smartwatch assembly 100 may use only the hour segments from the 3 o'clock position to the 9 o'clock position to indicate activity tracked by the smartwatch assembly 100 to a user.

In some embodiments, the smartwatch assembly 100 may acquire data required to track a user's activity from the plurality of sensors 162 (FIG. 7) included in the frame assembly 108 of the smartwatch assembly 100. In some embodiments, the smartwatch assembly 100 may acquire data required to track a user's activity from a smartphone. For example, the SW app may interface with other apps (e.g., HEALT KIT® and GOOGLE FIT®) and functions (e.g., global positioning) of the smartphone to acquire data required to track a user's activity. In other words, in some embodiments, the SW app may track an activity with the smartphone and the smartwatch assembly 100 may indicate the activity tracked by the SW app on the smartphone. In some embodiments, the smartwatch assembly 100 may acquire data required to track a user's activity from both of the plurality of sensors 162 (FIG. 7) and a smartphone.

Figure 9:
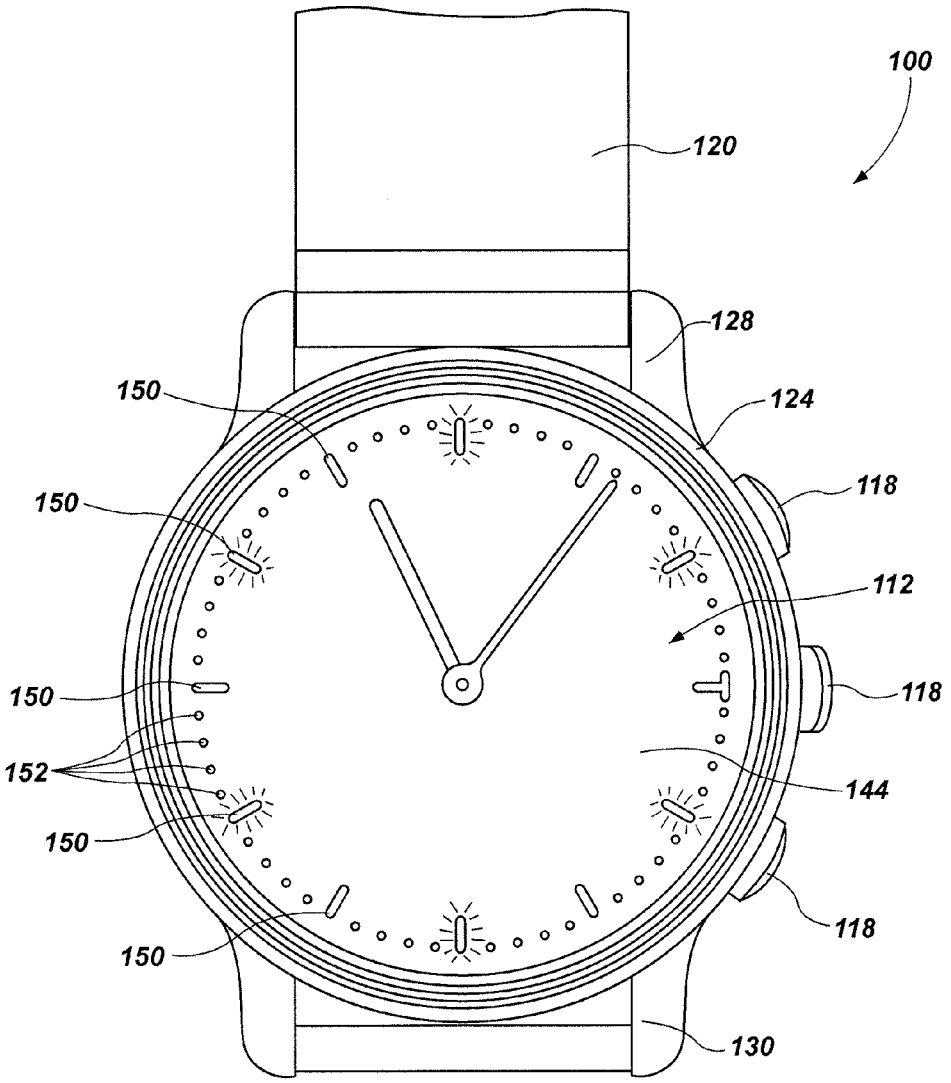
FIG. 9 is a front plan view of a smartwatch assembly showing a dial portion of the smartwatch assembly having a plurality of LED modules illuminated according to an embodiment of the present disclosure.

FIG. 9 is a partial front side of the smartwatch assembly 100 showing the dial portion 112 with a number of the plurality of LED modules 134 (FIG. 3) illuminated according to an embodiment of the present disclosure. Referring to FIGS. 3 and 9 together, as discussed above, in some embodiments, the one or more of the plurality of LED modules 134 may illuminate in response the user receiving an email, voicemail, phone call, and/or text on a smartphone. As discussed above, the smartwatch assembly 100 may be in wireless communication with a smartphone and the SW app may communicate with the smartwatch assembly 100 when an email, voicemail, phone call, and/or text are received on the smartphone. Furthermore, the SW app may communicate with the smartwatch assembly 100 to indicate reminders, appointments, alarms, tasks, etc. To facilitate description of the smartwatch assembly 100, each of the above-listed events will be described as an alert.

Referring to FIGS. 3, 4, and 9 together, in some embodiments, the control module 136 may cause one or more of the plurality of LED modules 134 to illuminate in different patterns to indicate what type of alert is being communicated by the smartphone. As a non-limiting example, the control module 136 may cause every other LED module 134 of the plurality of LED modules 134 to illuminate in response to a first type of alert. As another non-limiting example, control module 136 may cause the LED modules 134 of the plurality of LED modules 134 at the 2 o'clock, 4 o'clock, 8 o'clock, and 10 o'clock positions to illuminate in response to a second type of alert. Although specific patterns are described herein, as will be understood by one of ordinary skill in the art, any pattern could be used to indicate any of the above-listed alerts. Furthermore, how the smartwatch assembly 100 indicates an alert may be customizable by a user via the SW app. For example, the user may choose a pattern to be illuminated to indicate each type of alert.

Furthermore, in some embodiments, the above-listed alerts may be indicated and differentiated by different colored LED modules 134. For example, emails may be indicated with blue light, texts may be indicated with green lights, phone calls may be indicated with red lights, voicemails may be indicated with yellow lights, etc. A user may set which colors indicate which alerts with the SW app on the smartphone.

In some embodiments, in response to receiving an alert (e.g., email, text, voicemail, phone call, appointment, reminder, and alarm), the control module 136 may cause one or more of the plurality of LED modules 134 to be illuminated and the vibrator 160 (FIG. 7) to vibrate simultaneously. For example, an alert may be indicated by a combination of a pattern of LED modules 134 being illuminated and the vibrator 160 (FIG. 7) vibrating. Again, a user may be able to set how each alert is indicated using the SW app on a smartphone.

Having the smartwatch assembly 100 indicate alerts via the plurality of LED modules 134 and/or the vibrator 160 (FIG. 7) instead of an electronic display screen enables the smartwatch assembly 100 to maintain a classic analog appearance while providing smart features (e.g., activity tracking and provide alerts to a user). As a result, the smartwatch assembly 100 of the present disclosure may provide a more aesthetically pleasing appearance in comparison to other smartwatches. Moreover, because the smartwatch assembly 100 does not include an electronic display screen, the smartwatch assembly 100 may be smaller in size and may weigh less than other known smartwatches. Furthermore, because the smartwatch assembly 100 indicate alerts via plurality of LED modules 134 and/or the vibrator 160 (FIG. 7) instead of lighting up an electronic display screen or sounding a ringer, the smartwatch assembly 100 may be a less intrusive way for a user to stay aware of alerts during, for example, meetings, film showings, classes, or any other setting where ringing and/or constant buzzing of a smartphone may be inappropriate. Additionally, because the smartwatch assembly 100 differentiates to a user which type of an alert is being indicated, a user may more effectively filter which types of alerts the user may want inspect on his or her smartphone. For example, a user may be expecting a phone call and may be able to filter out other alerts without pulling out his or her phone during a meeting.

As another non-limiting example, the smartwatch assembly 100 may provide a more effective way to keep a user apprised of alerts during exercise. For example, instead of having to pull a user's smartphone out of his or her pocket or remove it from an armband during exercise to view what alert is being indicated by a smartphone, a user can simply glance at his or her watch and know what alert is being indicated.

Moreover, because the smartwatch assembly 100 is worn on a wrist of a user and is likely to be in constant contact with the skin of a user, with the vibrator 160 and plurality of LED modules 134, the smartwatch assembly 100 may provide a more effective way to alert a user of an alert than a conventional smartphone, which is typically carried in a pocket of the user and may not be noticed when vibrating, ringing, or lighting up.

Referring to FIGS. 7-9 together, because the smartwatch assembly 100 does not have an electronic display screen, the smartwatch assembly 100 may require significantly less energy to power the smartwatch assembly 100 in comparison to other known smartwatches. As a result, the smartwatch assembly 100 may be powered by two conventional batteries. For example, the smartwatch assembly 100 may be powered by a first cell (e.g., a CR2025 cell) for smart features of the smart watch assembly 100 and a second cell (e.g., a 364 cell) for timekeeping features of the smartwatch assembly 100. In some embodiments, the first cell may be able to provide sufficient power to the smartwatch assembly

100 for the smart features of the smartwatch assembly 100 to function for a period of at least about six months. Furthermore, the second cell may be able to provide sufficient power to the smartwatch assembly 100 for the timekeeping features of the smartwatch assembly 100 to function for a period of at least about five years. As a result, the smartwatch assembly 100 may not require any battery charging. In other words, the smartwatch assembly 100 may not include a permanent rechargeable battery.

By not requiring battery charging, the smartwatch assembly 100 may provide advantages over other known smartwatches. For example, conventional smartwatches having electronic display screens often require battery charging every three to four days. Having to charge the battery so often can become annoying and frustrating to a user. Furthermore, if a user forgets to charge the battery, the smartwatch becomes useless in both smart features and timekeeping features. Accordingly, by not requiring battery charging, the smartwatch assembly 100 of the current disclosure is more useful in settings where a user cannot charge a battery (e.g., traveling where power is not available) or does not want to have to worry about charging a battery of the smartwatch every few days.

In some embodiments, the smartwatch assembly 100 may be at least partially solar powered. For example, the face plate 144 of the dial portion 112 of the smartwatch assembly 100 may include solar cells. In some embodiments, the solar cells may power one or more of the smart features and timekeeping features of the smartwatch assembly 100.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternative useful combinations of the elements described, will become apparent to those skilled in the art from the description. Such modifications and embodiments also fall within the scope of the appended claims and equivalents.

What is claimed is:

1. A smartwatch assembly, comprising:
- a watch casing;
- a dial portion disposed in the watch casing and comprising:
  - a face plate;
  - a plurality of hour-mark apertures extending through the face plate; and
  - an hour hand extending from a center of the face plate and pointing, at least generally, toward one or more of the hour-mark apertures; and
- a circuit board disposed in the watch casing and comprising:
  - a board portion;
  - a plurality of LED modules disposed on the board portion and oriented to emit light through the plurality of hour-mark apertures of the dial portion;
  - a control module configured to illuminate at least one LED module of the plurality of LED modules in response to one or more alerts; and
  - a communication module configured to interface with an electronic device wirelessly and to receive the one or more alerts.

2. The smartwatch assembly of claim 1, wherein the one or more alerts include one or more of receiving an email, receiving a text, receiving a phone call, receiving a voicemail, an alarm, and a reminder on the electronic device.

3. The smartwatch assembly of claim 1, wherein the control module is configured to illuminate a first set of LED modules of the plurality of LED modules in response to a first alert and a second set of LED modules of the plurality of LED modules in response to a second alert.

4. The smartwatch assembly of claim 1, wherein the communication module is configured to communicate with the electronic device via low energy BLUETOOTH®.

5. The smartwatch assembly of claim 1, wherein the control module of the smartwatch assembly is further configured to track an activity of a user and to indicate progression of the activity by illuminating at least one of the plurality of LED modules.

6. The smartwatch assembly of claim 5, wherein the activity of the user includes one or more of walking, running, swimming, and sleeping.

7. The smartwatch assembly of claim 5, wherein the control module of the smartwatch assembly tracks the activity of the user via an app on a smartphone.

8. The smartwatch assembly of claim 5, wherein the smartwatch assembly does not include an electronic display screen.

9. The smartwatch assembly of claim 1, wherein the communication module is configured to interface with a smartphone.

10. A smartwatch assembly, comprising:
- a watch body;
- a dial portion disposed within the watch body and comprising:
  - a face plate having a plurality of hour-mark positions;
  - an hour hand extending radially from a center of the face plate; and
  - a minute hand extending radially from a center of the face plate;
- a plurality of light sources disposed within the watch body, the plurality of light sources being able to emit light of different colors; and
- a control module configured to illuminate one or more of the plurality of light sources, wherein the control module is configured to cause one or more of the plurality of light sources to emit a first color of light to indicate to a user a first notification from a smartphone in wireless communication with the smartwatch assembly and to cause one or more of the plurality of light sources to emit a second color of light to indicate to the user a second notification from the smartphone.

11. The smartwatch assembly of claim 10, wherein each of the first notification and the second notification is an alert regarding one or more of receiving an email, receiving a text, receiving a phone call, receiving a voicemail, an alarm, and a reminder on the smartphone.

12. The smartwatch assembly of claim 10, wherein the plurality of light sources comprises a plurality of LED modules.

13. The smartwatch assembly of claim 10, wherein each light source of the plurality of light sources is located and configured to emit light through the dial portion at a respective hour-mark position of the plurality of hour-mark positions.

14. The smartwatch assembly of claim 10, wherein the control module of the smartwatch assembly is further configured to track an activity of a user and to indicate progression of the activity by illuminating at least one of the plurality of light sources.

15. The smartwatch assembly of claim 10, wherein the smartwatch assembly does not include an electronic display screen.

16. The smartwatch assembly of claim 1, further comprising a light guide disposed between the dial portion and the circuit board, the light guide comprising:

a plate portion; and a plurality of light guide holes extending through the plate portion, each light guide hole of the plurality of light guide holes corresponding to an LED module of the plurality of LED modules.

17. The smartwatch assembly of claim 16, further comprising a light diffuser disposed between the light guide and the dial portion.

18. The smartwatch assembly of claim 17, wherein the light diffuser comprises a MYLAR® film.

19. The smartwatch assembly of claim 1, further comprising a frame assembly disposed on a side of the circuit board opposite the dial portion, wherein the frame assembly includes a vibrator.

20. The smartwatch assembly of claim 1, wherein the plurality of LED modules comprises white LED modules.

21. The smartwatch assembly of claim 1, further comprising:

a transparent portion attached to a first lateral side of the watch casing, wherein the dial portion of the smartwatch assembly is viewable through the transparent portion; and a back panel removably attached to a second lateral side of the watch casing opposite the first lateral side.

* * * * *